US011027160B2

(12) United States Patent
Pigeon

(10) Patent No.: US 11,027,160 B2
(45) Date of Patent: Jun. 8, 2021

(54) FIRE SPRINKLER SYSTEM

(71) Applicant: Firebird Sprinkler Company LLC, Ann Arbor, MI (US)

(72) Inventor: Jeffrey J. Pigeon, Ann Arbor, MI (US)

(73) Assignee: Firebird Sprinkler Company LLC, Ann Arbor, MI (US)

( * ) Notice: Subject to any disclaimer, the term of this patent is extended or adjusted under 35 U.S.C. 154(b) by 231 days.

(21) Appl. No.: 15/428,803

(22) Filed: Feb. 9, 2017

(65) Prior Publication Data

US 2017/0151455 A1 Jun. 1, 2017

Related U.S. Application Data

(63) Continuation of application No. 14/661,302, filed on Mar. 18, 2015, now abandoned.

(Continued)

(51) Int. Cl.
*A62C 35/68* (2006.01)
*A62C 3/00* (2006.01)

(Continued)

(52) U.S. Cl.
CPC ..... *A62C 35/68* (2013.01); *A62C 3/002* (2013.01); *A62C 31/02* (2013.01); *A62C 35/64* (2013.01);

(Continued)

(58) Field of Classification Search
CPC ..... B05B 1/267; A62C 37/11; A62C 35/64; A62C 35/68; A62C 3/002

(Continued)

(56) References Cited

U.S. PATENT DOCUMENTS 1,667,425 A 4/1928 Loepsinger
1,796,159 A * 3/1931 Pallady ..... F16L 19/0218 285/272

(Continued)

FOREIGN PATENT DOCUMENTS

DE 1899279 U 8/1964
DE 112006002211 7/2008

(Continued)

OTHER PUBLICATIONS

Globe Sprinkler, Specific Application Attic Sprinklers, GFS-650, Jun. 2019, pp. 1-29.

(Continued)

*Primary Examiner* — Jason J Boeckmann
(74) *Attorney, Agent, or Firm* — Endurance Law Group PLC

(57) ABSTRACT

A fire suppression system in which side-discharge fire sprinklers are fitted to opposite sides of a supply line and aimed so that their coverage areas point in opposite directions. The fire sprinklers are alternated on left and right-hand sides of the supply line, and are spaced apart at a consistent interval. Each fire sprinkler includes a deflector configured to disperse the outflow of water over a non-circular coverage area. When two supply lines are installed next to each other so that half of the sprinklers on one supply line point toward the other supply line, and vise versa, the fire sprinklers are staggered so that their respective coverage areas are interlaced in the intermediate space.

12 Claims, 9 Drawing Sheets

Related U.S. Application Data

(60) Provisional application No. 61/955,253, filed on Mar. 19, 2014, provisional application No. 62/019,527, filed on Jul. 1, 2014.

(51) Int. Cl.

| | |
|---|---|
| ***B05B 1/26*** | (2006.01) |
| ***A62C 35/64*** | (2006.01) |
| ***A62C 37/11*** | (2006.01) |
| ***A62C 31/02*** | (2006.01) |
| ***A62C 37/12*** | (2006.01) |

(52) U.S. Cl.
CPC ..... *A62C 37/11* (2013.01); *A62C 37/12* (2013.01); *B05B 1/267* (2013.01)

(58) Field of Classification Search
USPC ..... 169/16, 17, 37, 54; 239/282
See application file for complete search history.

(56) References Cited

U.S. PATENT DOCUMENTS

| | | | | |
|---|---|---|---|---|
| 2,684,121 | A | 7/1954 | Lim | |
| 3,454,097 | A | 7/1969 | Groos | |
| 3,833,062 | A * | 9/1974 | Livingston | A62C 99/009 169/15 |
| 4,091,876 | A * | 5/1978 | Valdatta | A62C 3/07 169/11 |
| 4,279,309 | A | 7/1981 | Fischer et al. | |
| 4,296,816 | A * | 10/1981 | Fischer | A62C 37/10 169/37 |
| 4,351,393 | A | 9/1982 | Tyree | |
| 4,624,414 | A | 11/1986 | Ferrazza | |
| 4,800,961 | A | 1/1989 | Klein | |
| 5,020,601 | A | 6/1991 | Retzloff et al. | |
| 5,097,906 | A | 3/1992 | Polan | |
| 5,669,449 | A | 9/1997 | Polan et al. | |
| 5,722,599 | A | 3/1998 | Fries | |
| 5,829,532 | A | 11/1998 | Meyer et al. | |
| 6,336,509 | B1 | 1/2002 | Polan et al. | |
| 6,637,518 | B1 * | 10/2003 | Hillier | A62C 35/023 169/16 |
| 7,137,455 | B2 | 11/2006 | Green | |
| 7,290,618 | B2 | 11/2007 | Thomas et al. | |
| 7,611,077 | B2 | 11/2009 | Sesser et al. | |
| 7,757,967 | B1 * | 7/2010 | Yang | A62C 37/08 169/37 |
| 7,841,418 | B2 | 11/2010 | Pahila et al. | |
| 8,474,545 | B2 | 7/2013 | Takeuchi | |
| 8,544,556 | B2 | 10/2013 | Sundholm et al. | |
| 8,602,118 | B2 * | 12/2013 | Pigeon | A62C 37/14 169/37 |
| 9,302,132 | B2 | 4/2016 | Green et al. | |
| 9,339,675 | B2 | 5/2016 | Koiwa | |
| 9,381,386 | B2 | 7/2016 | Pigeon | |
| 9,849,321 | B2 | 12/2017 | Huotari et al. | |
| 9,868,005 | B2 | 1/2018 | Green et al. | |
| 2005/0045739 | A1 | 3/2005 | Multer | |
| 2007/0256844 | A1 | 11/2007 | Blasing et al. | |
| 2008/0202773 | A1 | 8/2008 | Pigeon | |
| 2009/0218109 | A1 | 9/2009 | Sato | |
| 2015/0265865 | A1 | 9/2015 | Pigeon | |
| 2016/0023031 | A1 | 1/2016 | Thomas | |
| 2016/0375288 | A1 | 12/2016 | Pigeon | |
| 2017/0259095 | A1 | 9/2017 | Pigeon | |

FOREIGN PATENT DOCUMENTS

| | | | |
|---|---|---|---|
| GB | 532837 | A | 1/1941 |
| WO | 2009108944 | A2 | 9/2009 |
| WO | 2013148429 | A2 | 10/2013 |

OTHER PUBLICATIONS

Johnson Controls, TYCO Models BB, SD, HIP, and AP Specific Application Sprinklers For Protecting Attics, TFP610, Aug. 2018, pp. 1-28.

Reliable Sprinkler, Models DD56-6, DD56-27, DD80-6, DD80-27, DS56, GP56, AH42, & AH56 Sprinklers: Specific Application Sprinklers for Attic Spaces, Bulletin 056 May 2019, www.reliablesprinkler.com, pp. 1-26.

Viking Group, Inc., Model V-BB Specific Application Attic Sprinkler Technical Data, Form No. F_042915, Oct. 25, 2018 Rev. 16.2.P65, pp. 1-15.

* cited by examiner

FIRE SPRINKLER SYSTEM

CROSS REFERENCE TO RELATED APPLICATIONS

This application is a continuation of U.S. application Ser. No. 14/661,302 filed Mar. 18, 2015, which claims priority to Provisional Patent Application No. 61/955,253 filed Mar. 19, 2014 and also to Provisional Patent Application No. 62/019,527 filed Jul. 1, 2014, the entire disclosures of which are hereby incorporated by reference and relied upon.

BACKGROUND OF THE INVENTION

Field of the Invention

The invention relates generally to methods and systems for extinguishing fires, and more particularly to sprinklers of such systems.

Description of Related Art

Fire suppression systems have been used in the United States to protect warehouses and factories for many years. In a fire suppression system, a fire sprinkler is positioned near the ceiling of a room where hot "ceiling jets" spread radially outward from a fire plume. When the temperature at an individual sprinkler reaches a pre-determined value, a thermally responsive element in the sprinkler activates and permits the flow of water as a water jet through a duct toward a deflector. The deflector redirects the water jet into thin streams or "ligaments" that break up into droplets due to surface tension. The water droplets deliver water to the burning material, reduce the combustion rate, wet the surrounding material, reduce the flame spread rate, cool the surrounding air through evaporation and displace air with inert water vapor.

Fire suppression systems can comprise a water distribution piping system to which a plurality of spaced-apart fire sprinklers are connected. Fire suppression systems and methods of installation are described in detail in my U.S. Pat. No. 8,602,118 (issued Dec. 10, 2013) and U.S. Pat. No. 8,733,461 (issued May 27, 2014), the entire disclosures of which are hereby incorporated by reference and relied upon.

When fire sprinkler heads are located close to each other, the risk of "cold soldering" becomes a concern. Cold soldering occurs when one fire sprinkler disperses a fire suppressing or extinguishing substance that directly cools a nearby fire sprinkler and prevents the latter fire sprinkler from properly responding and activating. Prior art pendant-type sprinklers are held closed by a trigger in the form of either a heat-sensitive glass bulb or a two-part metal link held together with fusible alloy. The trigger applies pressure to a closure element which acts as a plug in the sprinkler nozzle to prevent water from flowing until the ambient temperature around the sprinkler reaches the design activation temperature of the individual sprinkler head. Sprinkler heads located in open structures (i.e., not adjacent a wall, ceiling or beam) are commonly oriented vertically overhead (either pointing up or pointing down) and are provided with a deflector positioned in the path of water spray from the nozzle. The deflector redirects the vertically-discharged water jet into thin streams or "ligaments" that spread out uniformly in all directions (i.e., in a 360° discharge pattern) above burning materials to reduce the combustion rate, wet the surrounding material, reduce the flame spread rate, cool the surrounding air through evaporation and displace combustion air with inert water vapor.

Side-discharge sprinklers are a special type of fire sprinkler used in applications immediately adjacent a wall or beam or other blocking structure, as shown in FIGS. 1 and 2, which are taken from U.S. Pat. No. 7,331,399, the entire disclosure of which is hereby incorporated by reference. Side-discharge sprinklers are typically mounted in a horizontal orientation, as contrasted with the more common types of sprinkler heads which are mounted vertically up or vertically down (pendant). A typical side-discharge sprinkler can discharge approximately the same flow rate of water as the standard vertical mount design, but the distribution pattern of the water from a side-discharge sprinkler is directional and dispersed over a region generally about 180° (as compared with 360° in a vertical mount sprinkler). That is, a side-discharge sprinkler can discharge the same amount of water over time as that of a standard vertical mount type, but will distribute the water over roughly half the area due to is half-circle discharge pattern. As a result, the density of water per unit area of ground is greater for a side-discharge sprinkler. In fire suppression sciences, it is widely understood that the more water per unit time that can be delivered to burning material, the greater the reduction of combustion rate, better wetting, and so forth.

Despite their ability to discharge a greater water density, side-discharge sprinklers cannot be used in open surround conditions (i.e., located in the middle space between two structural beams (or girders, trusses, etc.) due to their inherent directional discharge patterns. In open surround conditions, a 360° discharge pattern is almost always used. Furthermore, side-discharge sprinklers cannot be positioned near one another due to the aforementioned cold soldering problem.

There is a need in the fire suppression and extinguishment field to create an improved fire sprinkler system that delivers a maximum density of water per unit area of ground but without the risk of cold soldering the trigger of nearby sprinkler heads.

BRIEF SUMMARY OF THE INVENTION

According to a first aspect of this invention, an over-head fire suppression system is provided for warehouse applications. The over-head fire suppression system is configured to disperse a fire suppressing liquid in a steam-like downward trajectory onto a storage area below. The system comprises an elongated tubular supply line configured as a conduit to carry pressurized fire-suppressing liquid. The supply line has a longitudinal centerline. The supply line has right and left sides separated by a vertical plane passing through the longitudinal centerline. A plurality of side-discharge fire sprinklers are coupled directly to the supply line. Each fire sprinkler is configured to receive a flow of fire-suppressing liquid from the supply line. Each fire sprinkler includes a deflector configured to disperse the flow of fire-suppressing liquid in a downward trajectory over a non-circular coverage area defined by a major diameter and a shorter minor diameter. The plurality of fire sprinklers are arranged so that half of the fire sprinklers are disposed on the right side of the supply line and the other half of the fire sprinklers are disposed on left side of the supply line in alternating fashion such that every other the fire sprinkler is disposed on the right side of the supply line with the other the fire sprinklers disposed in interleaved fashion on the left side of the supply line.

According to another aspect of this invention, an over-head fire suppression system for warehouse applications is configured to disperse a fire suppressing liquid in a steam-like downward trajectory onto a storage area below. The system comprises a first elongated tubular supply line configured as a conduit to carry pressurized fire-suppressing liquid. The first supply line has a longitudinal centerline and right and left sides separated by a vertical plane passing through the longitudinal centerline. A plurality of side-discharge first fire sprinklers are coupled directly to the right side of the first supply line. Each first fire sprinkler is configured to receive a flow of fire-suppressing liquid from the first supply line. Each first fire sprinkler includes a deflector configured to disperse the flow of fire-suppressing liquid in a downward trajectory over a non-circular coverage area. Each first fire sprinkler is separated from the next adjacent the first fire sprinkler by a generally equal spacing interval. A second elongated tubular supply line is configured as a conduit to carry pressurized fire-suppressing liquid. The second supply line has a longitudinal centerline and right and left sides separated by a vertical plane passing through the longitudinal centerline. The second supply line is disposed parallel to the first supply line with the left side of the second supply line facing toward the right side of the first supply line. A plurality of side-discharge second fire sprinklers are coupled directly to the left side of the second supply line. Each second fire sprinkler is configured to receive a flow of fire-suppressing liquid from the second supply line. Each second fire sprinkler includes a deflector configured to disperse the flow of fire-suppressing liquid in a downward trajectory over a non-circular coverage area. Each second fire sprinkler being separated from the next adjacent the second fire sprinkler by a generally equal spacing interval. The spacing interval between the first fire sprinklers is generally equal to the spacing interval between the second fire sprinklers. The non-circular coverage areas from the first fire sprinklers are interlaced between the non-circular coverage areas from the second fire sprinklers.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
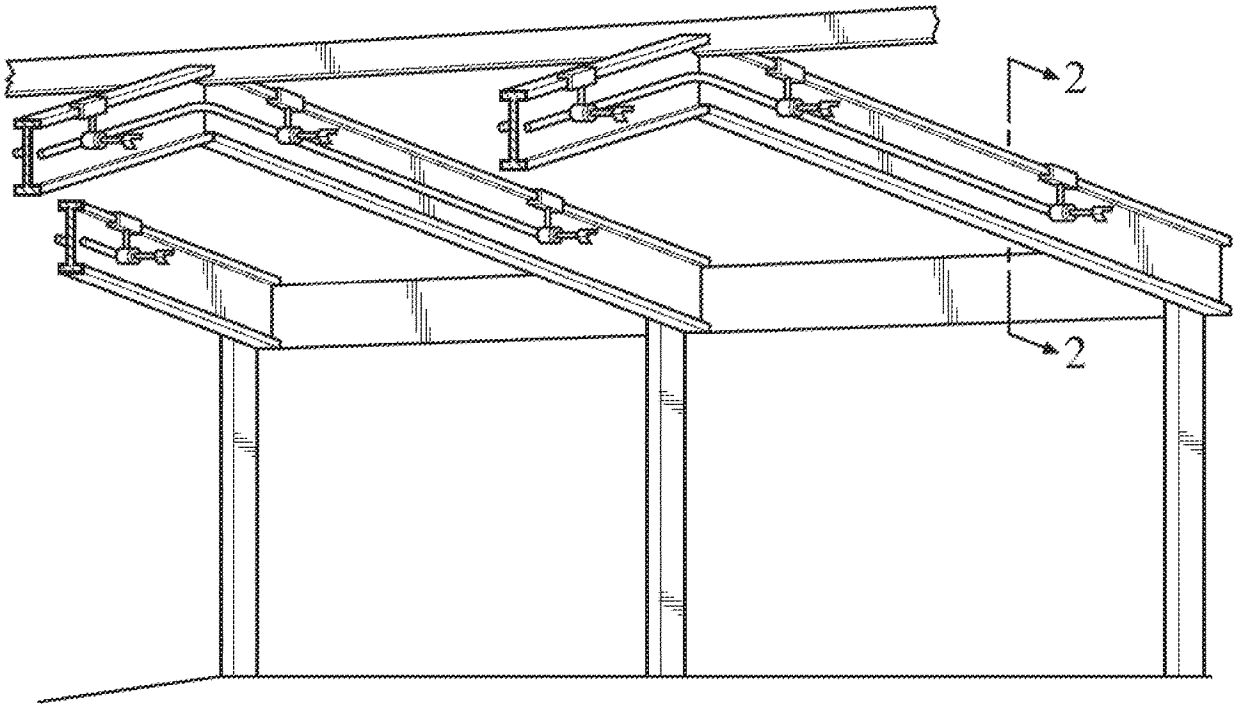
FIG. 1 PRIOR ART
FIG. 1 is a simplified perspective view of a building interior in which are installed prior are side-discharge sprinklers along opposing faces of structural beams.
Figure 3:
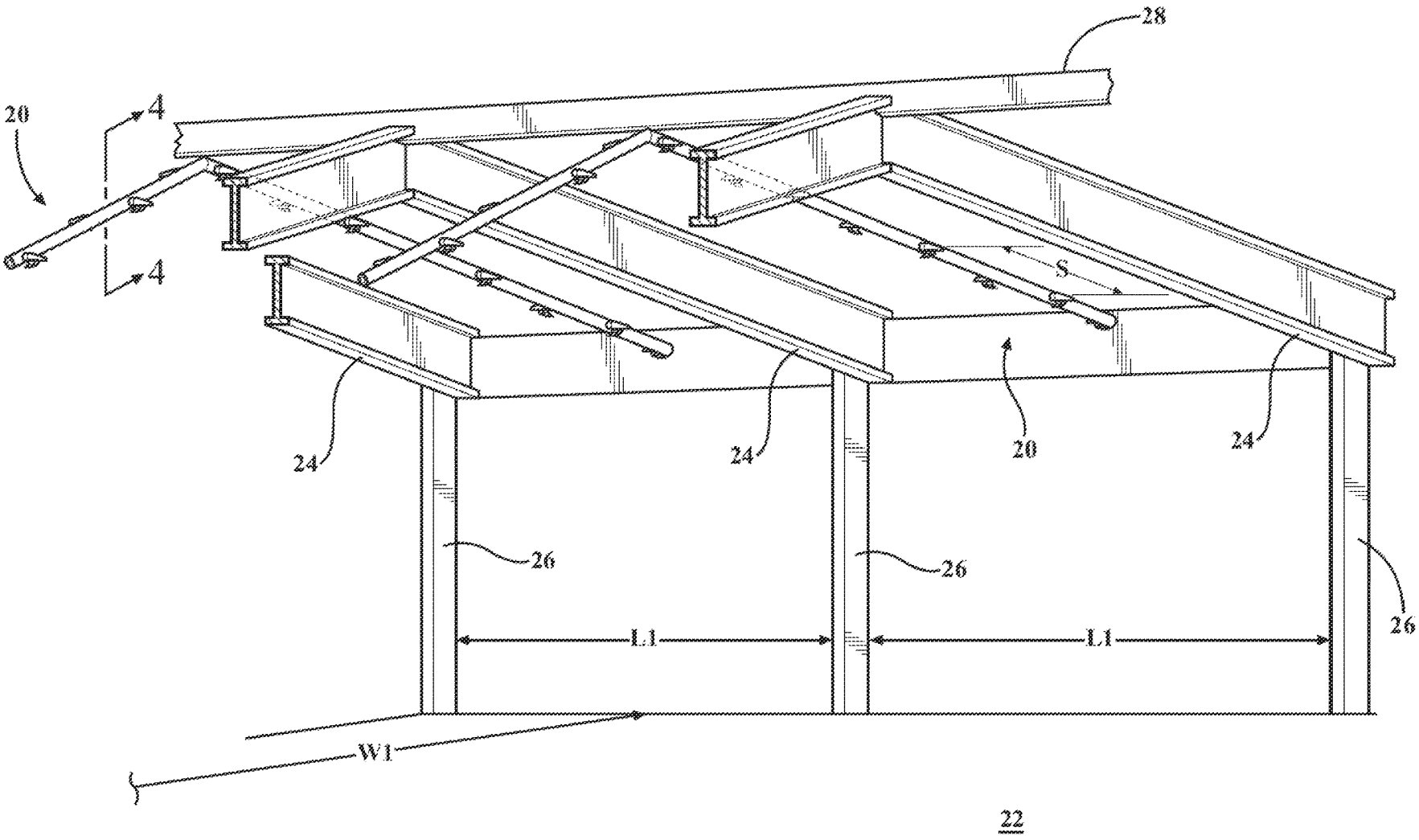
FIG. 3 is a perspective view of a building interior as in FIG. 1 but fitted a fire suppression system according to one embodiment of the present invention.

Referring to the figures, wherein like numerals indicate like or corresponding parts throughout the several views, a fire suppression system according to one exemplary expression of the present invention is generally shown at 20 in FIGS. 3-9. In FIG. 3, the fire suppression system 20 is shown located in the interior storage space of a building structure. The building structure may be a warehouse having a floor 22, and at least three beams 24 suspended over the floor 22. The beams 24 are preferably steel I-shaped rafters, but may be any suitable structural member made from any suitable material and shaped in any suitable manner. The beams 24 are typically arranged parallel to one another and spaced evenly apart by an interior bay length L1. In this example, the three beams 24 may be consider first, second and third beams 24, with the second beam being disposed in between the first and third beams 24. Each beam 24 is supported by a pair of substantially vertical uprights or posts 26 spaced apart from one another by an interior bay width W1. In some constructions, purlins (not shown) may be placed perpendicularly across the beams 24 to support a ceiling or roof 27. In the example of FIG. 3, the ceiling or roof 27 is oriented at a skewed or pitched angle relative to the floor 22, however flat roof constructions are also certainly possible as suggested by FIG. 6. In any event, the beams 24 are oriented so as to run perpendicular to the high-point of the roof which, in FIG. 3, is illustrated in the form of a ridge 28. That is to say, the pitch of the roof 27 typically runs parallel to the beams 24 and parallel to the W1 dimension. In steel frame structures like those depicted in FIGS. 1 and 3, the regions between adjacent beams 24 and spanning their full width are often referred to as bays. Each bay is therefore defined by the above-noted length and width variables L1 and W1. Commonly, the bay width W1 is at least 20 feet (6 m) and the bay length L1 is at least 20 feet (6 m), although often one or both of these measures are greater. The pitch of the roof 27 slopes along the bay width W1.

The fire suppression system 20 includes at least one, but preferably a plurality of supply lines 30. Each supply line 30 comprises a fluid-conducting conduit or pipe suspended below the roof 27 of the structure, such as from its purlins (not shown) or by other suitable accommodation. The several elongated tubular supply lines 30 within a building structure are fed, usually via a common manifold, with pressurized fire-suppressing liquid, such as water or other suitable material, from a source under pressure. The supply lines 30 may be located in the middle space between two structural beams 24 (or girders, trusses, etc.) in the building structure. That is, the supply lines 30 are advantageously located generally along the centerline of each bay area, with one supply line 30 per bay, however these are not requirements and other configurations are certainly possible. Therefore, in applications with multiple supply lines 30, the supply lines 30 are arranged generally parallel to one another under the roof 27 so that they all extend perpendicular (or at least not parallel) to the ridge 28 or other high point feature of the roof 27.

Figure 4:
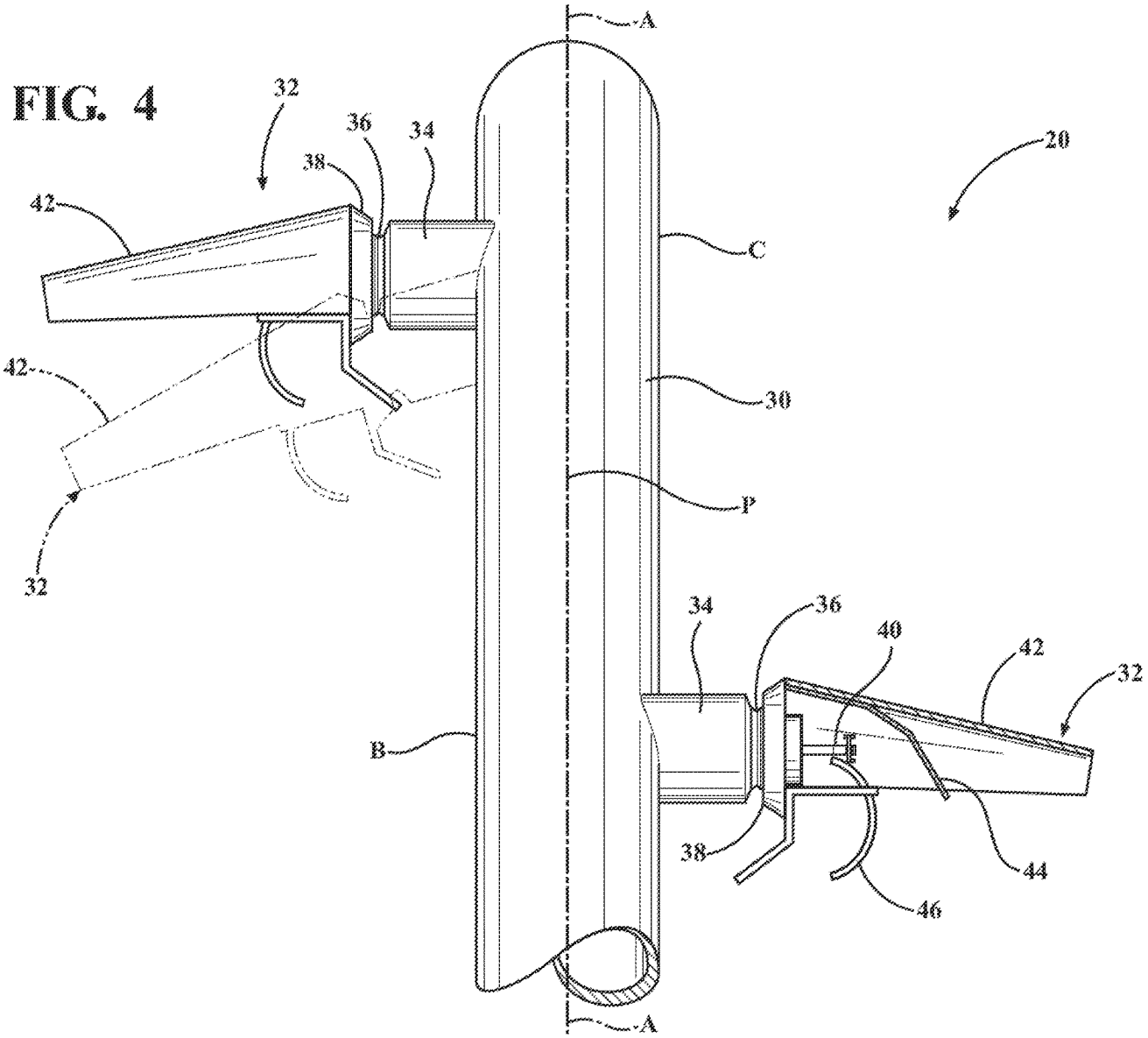
FIG. 4 cross-sectional view as taken generally along lines 4-4 of FIG. 3 showing of a section of supply line supporting two side-discharge fire sprinklers arranged in opposite-facing directions and where the deflector of one fire sprinkler is in partial cross-section.
Figure 5:
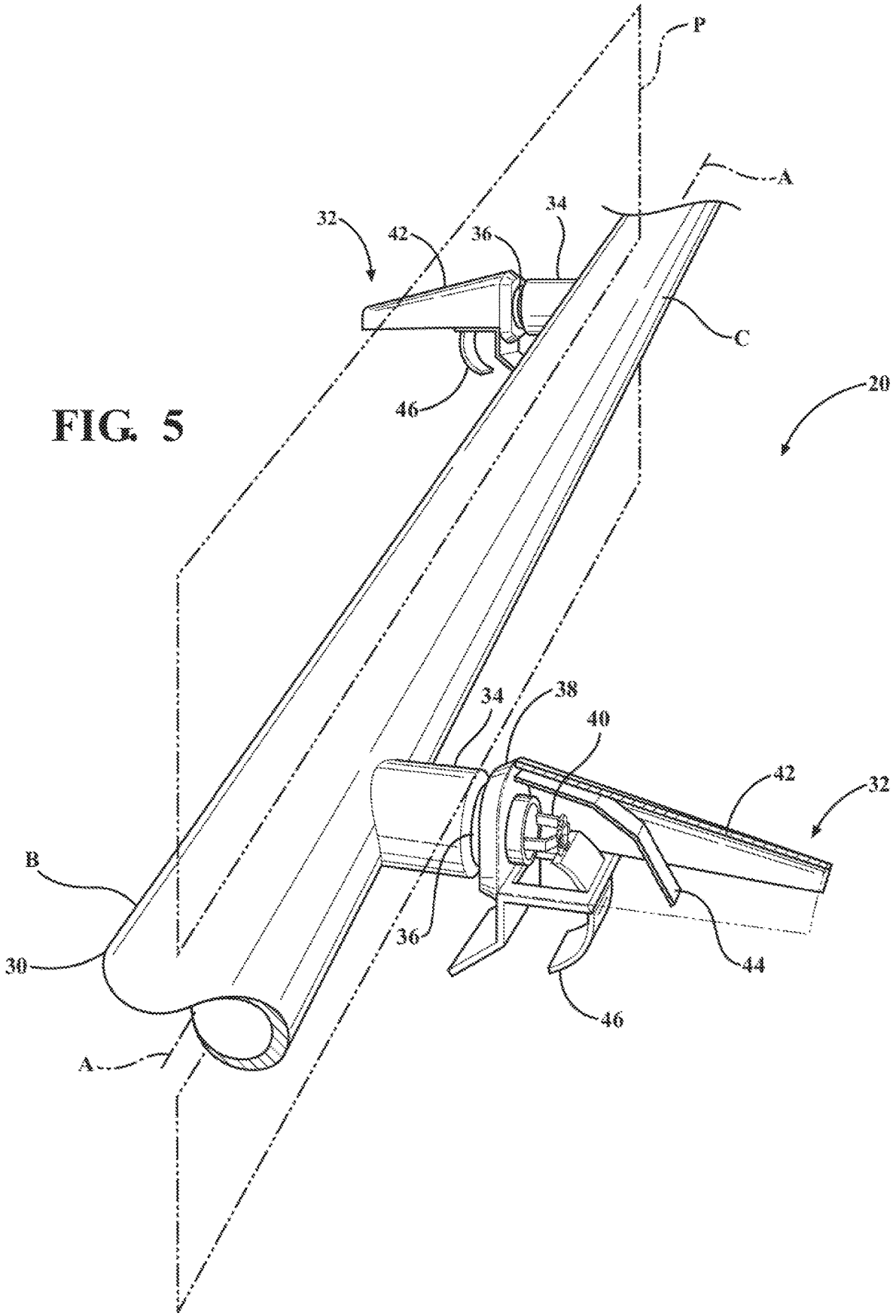
FIG. 5 is a perspective view of the section of supply line shown in FIG. 4 again with the deflector of one fire sprinkler depicted in partial cross-section.

Each supply line 30 has a longitudinal centerline A with right C and left B sides separated by an imaginary vertical plane P that passes through the longitudinal centerline A, as shown in FIGS. 4 and 5. In situations where multiple supply lines 30 are used, one supply line 30 may be deemed a first supply line 30 and the next adjacent supply line a second supply line 30. The second supply line 30 is typically disposed parallel to the first supply line 30 and is perpendicularly spaced to either the left B or the right C therefrom. The first and second supply lines 30 may be generally identical to one another such that which is the first and which is the second is of little consequence. Because the first and second supply lines are next to one another, the right side C of one will face the left side B of another.

Side-discharge style fire sprinklers 32, sometimes referred to herein as a sprinkler head or merely a head, are part of an installed active fire suppression system disposed in a warehouse or other space needing a high level of fire protection. The fire sprinklers 32 are disposed in series along each supply line 30 at regular intervals. In some applications, the interval spacing may be about two-to-ten feet depending on design criteria. In the accompanying illustrations, each fire sprinkler 32 is shown approximately two-feet from the next adjacent sprinkler head 32 on the same supply line 30, although the adjacent sprinkler heads 32 are aimed in opposite directions. Preferably, each fire sprinkler 32 is of the side discharge type, as opposed to a vertical type like the ubiquitous pendant head. That is, the sprinkler heads 32 are designed to be attached to the supply line 30 so that they extend outwardly in a horizontal or generally horizontal (i.e., non-vertical) direction. Typical prior art side discharge sprinkler heads disperse water over a generally semi-circular area. While standard prior art side discharge sprinkler heads are suitable for use with the present invention, in the preferred embodiment the sprinkler heads 32 are specially configured to disperse water over a long, narrow, well-defined, coverage area 64 which many be elliptical, oval or rectangular.

The plurality of fire sprinklers 32 are arranged along a common supply line 30 so that half of the fire sprinklers are disposed on the right side C of the supply line 30 and the other half of the fire sprinklers 32 are disposed on left side B of the supply line 30. At the location where each fire sprinkler 32 is intended to adjoin the supply line 30, a saddle 34 is fitted in place. Each saddle 34 perpendicularly intersects the supply line 30. The saddle 34 is provided with a central aperture (not visible) that fluidly connects with the internal conduit region of the supply line 30 so that an outflow of fire-suppressing liquid can travel from the supply line 30 into the central aperture when the sprinkler head 32 is activated. The surrounding body of the central aperture has a threaded interior surface that is designed to mate with external threads of the sprinkler 32. During fabrication of a fire suppression system, an installer will typically drill holes in the supply line 30 at the locations where fire sprinklers 32 are desired. Half of the holes will be drilling on the left side L, and the other half on the right side R of the supply line 30. Saddles 46 are then welded or otherwise sealed to the supply line 30 over the drilled holes. Finally, fire sprinklers 32 are screwed into respective saddles 34 prior (or subsequent) to hanging the supply line 30 from the supporting structure in the warehouse or other building structure similar to that shown in FIG. 3.

Two supply lines 30 are illustrated in FIG. 3, which for purposes of discussion may be referred to as the first and second supply lines 30. The spacing between the first supply line 30 and the second supply line 30 is approximately equal to the bay length L1 of either bay. Because of the wide spacing between adjacent first and second supply lines 30 enabled by this invention, as will be described below in connection with FIGS. 8 and 9, the installer is afforded substantially greater freedom to locate supply lines 30 far from the beams 24 which might otherwise present an obstruction to the spray pattern. FIG. 3 represents a scenario where the supply lines 30 are set so that only one supply line 30 is between each adjacent pair of beams 24. This represents a substantial reduction in the number of supply lines 30 to be installed as compared with prior art systems, and therefore a significant reduction in system/installation costs and long-term maintenance expenses, as well as an improvement in fire suppression performance.

The fire suppression system 20 shown in FIGS. 3-9 depicts use of a special application listed side-discharge-type sprinkler. The side-discharge sprinkler 32 includes a threaded nipple 36 that is configured with external thread forms to be screwed into a threaded female saddle 34. A frame 38 is supported from the nipple 36. The frame 38, in turn, supports a trigger 40 and a deflector. The deflector can be any device that shapes the dispersion of water, including nozzle-like elements as well as more traditional deflecting and diffusing features. In the illustrated examples, the deflector includes an elongated, nozzle-like hood 42 having a downward slant to efficiently direct water flow so as to achieve a desired coverage area with minimal splash or turbulence. The deflector also includes an optional baffle 44. The baffle 44 in these examples is a thin, strip-like element that is supported below the hood 42. The baffle 44 is somewhat cantilevered and arranged to extend outwardly with the hood 42, i.e., perpendicular to the supply line 30. The width of the baffle 44 is considerably less than the interior width of the hood 42 so that a substantial quantity of discharged water will flow unaffected around the sides of the baffle 44. In use, the baffle 44 provides at least two beneficial functions. Prior to activation of a fire sprinkler 32, the baffle 44 provides a measure of passive protection to the thermally responsive element 40 from the spray of an adjacent sprinkler 32 so as to reduce the possibility of cold soldering. In cases where an adjacent sprinkler 32 is earlier activated, the incoming fluid spray will be at least partially deflected by the baffle 44. After activation of a fire sprinkler 32, the baffle 44 assists like a dynamic flow control vane to help evenly distribute fire suppressing liquid within the coverage area. The deflector is also shown including a downwash section 46 which, like the baffle 44, also acts as a splash shield and helps evenly distribute fire suppressing liquid within the coverage area—particularly below the supply line 30. Naturally, the deflector shown in the accompanying Figures may be highly modified with additional flow controlling features in order to achieve a well-defined coverage area 64 with water density distribution characteristics as may be desired.

A duct extends through the nipple 36 to create an internal flow path for water or other fire suppressing substance from the supply line 30 along an outflow axis. The outflow axis is generally perpendicular to the longitudinal extent of the supply line 30, and in one preferred embodiment is generally horizontal. That is to say, the outflow axis may be generally parallel to the floor 22, however as suggested in phantom in FIG. 4 the outflow axis may be skewed from horizontal in certain applications as a means to achieve the desired spray coverage area 64. A plug-like closure element that is mated with the trigger 40 blocks the duct until activated by an elevated internal building temperature. Once the trigger 40 is tripped, the closure is ejected and water (or other substance in the supply line 30) rushes out under pressure through the duct along the outflow axis and collides with the deflector to spray over a non-circular individual coverage area 64. The trigger 40 is a thermally responsive element that responds to heat from a fire plume and then releases the closure, thereby permitting the flow of the fire suppressing or extinguishing substance. The thermally responsive element is preferably a fusible link assembly comprised of two link halves which are joined by a thin layer of solder. When the rated temperature is reached, the solder melts and the two link halves separate, allowing the sprinkler 32 to activate and water to flow. Alternatively, the trigger 40 may be of the glass bulb type which is designed to shatter when the rated temperature is reached, or any other suitable device or method. The trigger 40 may include any suitable method or device to block the flow of the fire suppressing or extinguishing substance through the duct until activated.

As stated above, on any given sully line 30, half of the sprinklers 32 are placed on the right side C and the other half on the left side B. More preferably, the plurality of fire sprinklers 32 are arranged in alternating fashion on the right C and left B sides of the supply line 30 such that every other fire sprinkler 32 is disposed on the right side C of the supply line 30 with the other fire sprinklers 32 disposed on the left side B of the supply line 30. Thus, every other side-discharge-type sprinkler 32 is set in an opposite-facing direction along the same supply line 30. In this arrangement, any two adjacent sprinklers 32 may be considered a pair with one of the sprinklers 32 pointing left and the other fire sprinkler 32 pointing right. The pair of fire sprinklers 32 may be identical to one another or distinct. The drawings describe the embodiment where the sprinklers 32 on the left side B are longitudinally offset from the sprinklers 32 on the right side C. However, in another contemplated application the sprinklers 32 are located in direct back-to-back relationship.

In order to effect this opposite-facing arrangement, the saddles 20 of the respective sprinklers 32 are fixed on horizontally opposite sides of the same supply line 30, so that their respective outflow axes each perpendicularly intersect the supply line 30. As shown by the phantom lines in FIG. 4, it is contemplated that one saddle 34 (or both) may be placed so that the sprinkler 32 extends at a skewed angle relative to horizontal as an alternative to bending or otherwise adjusting the positon of the hood 42. Indeed, some applications may lend themselves to orienting the two opposite-facing sprinkler heads 32 at different angles relative to horizontal. As an example, the right side sprinkler head 32 may be angled 5 degrees below horizontal, and the left side sprinkler 32 angled 10 degrees below horizontal in order to aim the sprayed water relative to the overall height and location of any storage items.

Figure 2:
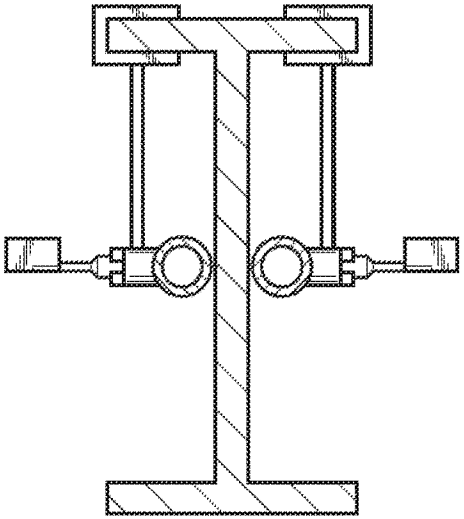
FIG. 2 PRIOR ART
FIG. 2 is a cross-sectional view taken generally along lines 2-2 of FIG. 1.

In order to address the potential of cold soldering due to two sprinkler heads 32 being located so close to one another, at least one blocking surface is supported on the supply line 30 in-between the two fire sprinklers 32. That is, the blocking surface is a component of the fire suppression system 20 and as such is supported by the supply line 30 or by a component (e.g., a sprinkler head 32) which in turn is supported by the supply line 30, rather than comprising a feature of the building structure like that shown in FIGS. 1 and 2. The blocking surface is configured to block fire-suppressing liquid that is discharged from one of the fire sprinklers 32 from contacting the other fire sprinkler 32 which could otherwise negatively influence the trigger 40 of the second fire sprinkler 32 from activating in a timely fashion. The blocking surface may take many different forms. That is to say, without the blocking surface, the close-spacing of these two side-discharge sprinklers 32 would cause spray from the first-activated sprinkler 32 to over-cool the adjacent (but not yet activated) sprinkler 32 and thereby delay its activation (i.e., not allow the second sprinkler 32 to operate according design specifications). However, with the blocking surface both side-discharge sprinklers 32 can operate essentially independent of one another and fully according to their design specifications.

In the illustrated embodiment, the blocking surface comprises the unique shape of the deflector in which the trigger 40 is substantially shrouded and enclosed. Indeed, the trigger 40 is only exposed from the discharge end of the deflector and from below, where a gap in the downwash member 46 is provided. This distinctive configuration allows heat rising from a fire to directly enter the deflector and be channeled toward the trigger 40. The deflector in fact collects and concentrates the heat onto the trigger 40 thereby encouraging early activation. However, the trigger 40 is otherwise shrouded from water spray caused any other nearby sprinklers 32. As a result, the possibility of cold soldering is substantially eliminated.

In this manner, the deflector creates a cave-like shell around the sides and top of the trigger 40; only the discharge direction and the bottom of the cave-like enclosure are open. Accordingly, the blocking surface fulfills several functions simultaneously to enable effective use of side-discharge-type sprinklers arranged on opposite-facing sides of the same supply-line 30 in a warehouse application. These include acting as a splash guard to prevent water that sprays sideways or rearwardly (e.g., in response to contact with an obstruction) from reaching the trigger 40 of a nearby sprinkler 32, reflecting heat onto the unactuated trigger 40 of the sprinkler 32 so that the trigger 40 will activate in a timely fashion if/when needed, and shaping the water flow to achieve a desired coverage area 64 and water density distribution.

In another contemplated variation (not shown), a standard prior art side-discharge sprinkler head is used and the blocking surface comprises a backer plate that is associated with each sprinkler head. The backer plate could be a formed sheet-metal member and arranged to overhang the sprinkler like a small roof. Such a backer plate could be integrated with the deflector and/or the frame of a sprinkler head. In any event, the backer plate must be effective to negate the condition known as cold-soldering that could otherwise arise in the event a first sprinkler is set-off prior to the second sprinkler.

Figure 6:
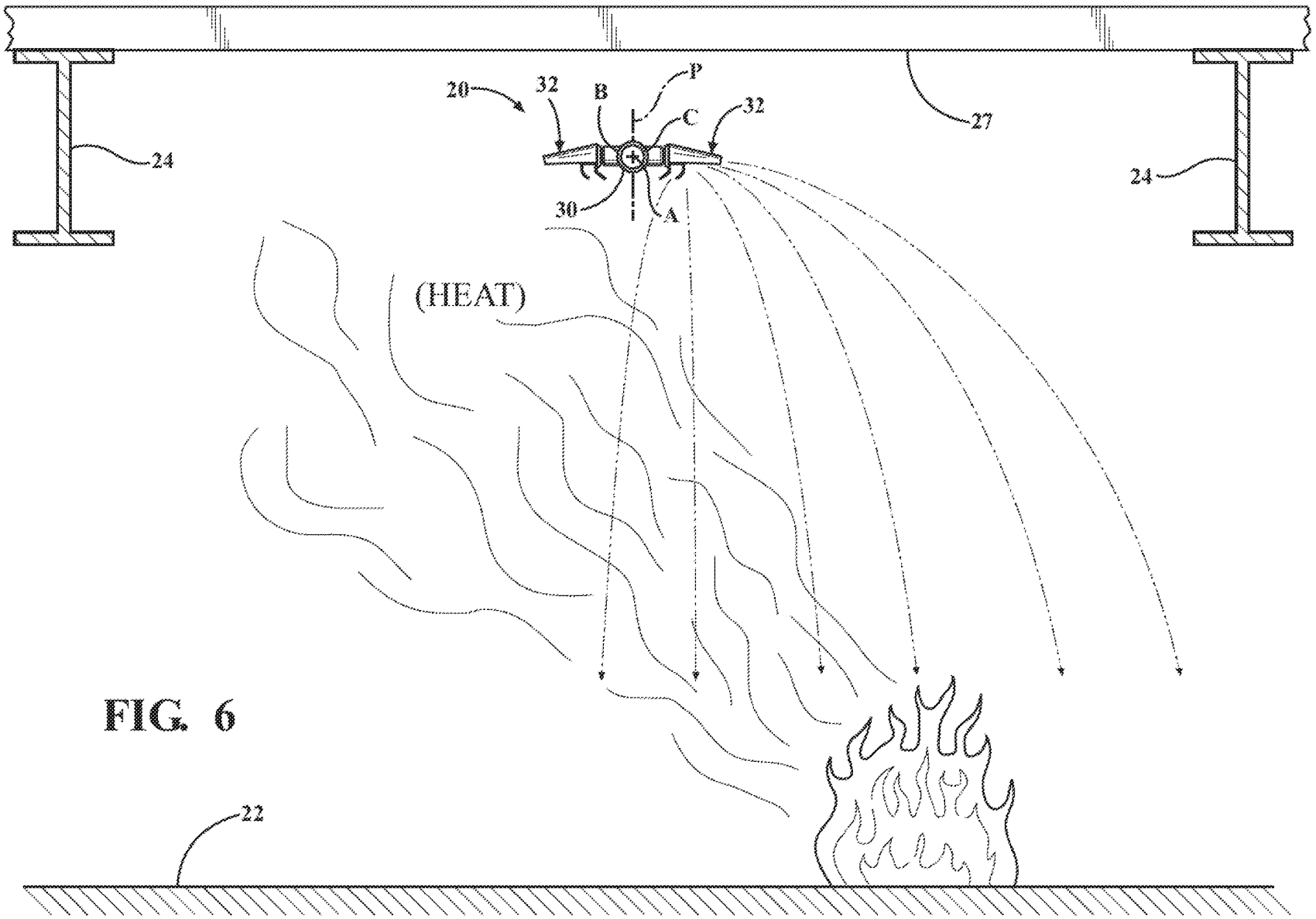
FIG. 6 is a simplified view of the present fire suppression system in which one side has been activated to suppress a fire below.

FIG. 6 shows two side-discharge sprinklers 32 arranged opposite-facing directions above a bay area between two adjacent beams 24 and covered by a roof 27. In this illustration, a fire has broken out on the right side of the bay area below the fire suppression system 20, setting off the right side-discharge sprinkler 32 but not the left side-discharge sprinkler 32. As water (or other liquid substance) sprays from the right side-discharge sprinkler 32, the blocking surface associated with the right side-discharge sprinkler 32 deflects the water spray so that it cannot contact the left side-discharge sprinkler 32. Meanwhile, the left side-discharge sprinkler 32 is poised to activate in a timely fashion if/when needed. This ready condition of the left side-discharge sprinkler 32 is passively facilitated by its associated blocking surface. In particular, the blocking surface of the left side-discharge sprinkler 32 acts as a shield that prevents collateral overspray and water splashes from contacting its unactuated trigger 40 (i.e., to prevent cold-soldering). Furthermore, the blocking surface of the left side-discharge sprinkler 32 reflects and funnels heat from the fire toward its trigger 40 so that its activation timing is not adversely affected (i.e., delayed) by the ambient water spray from the right side-discharge sprinkler 32.

Figure 7:
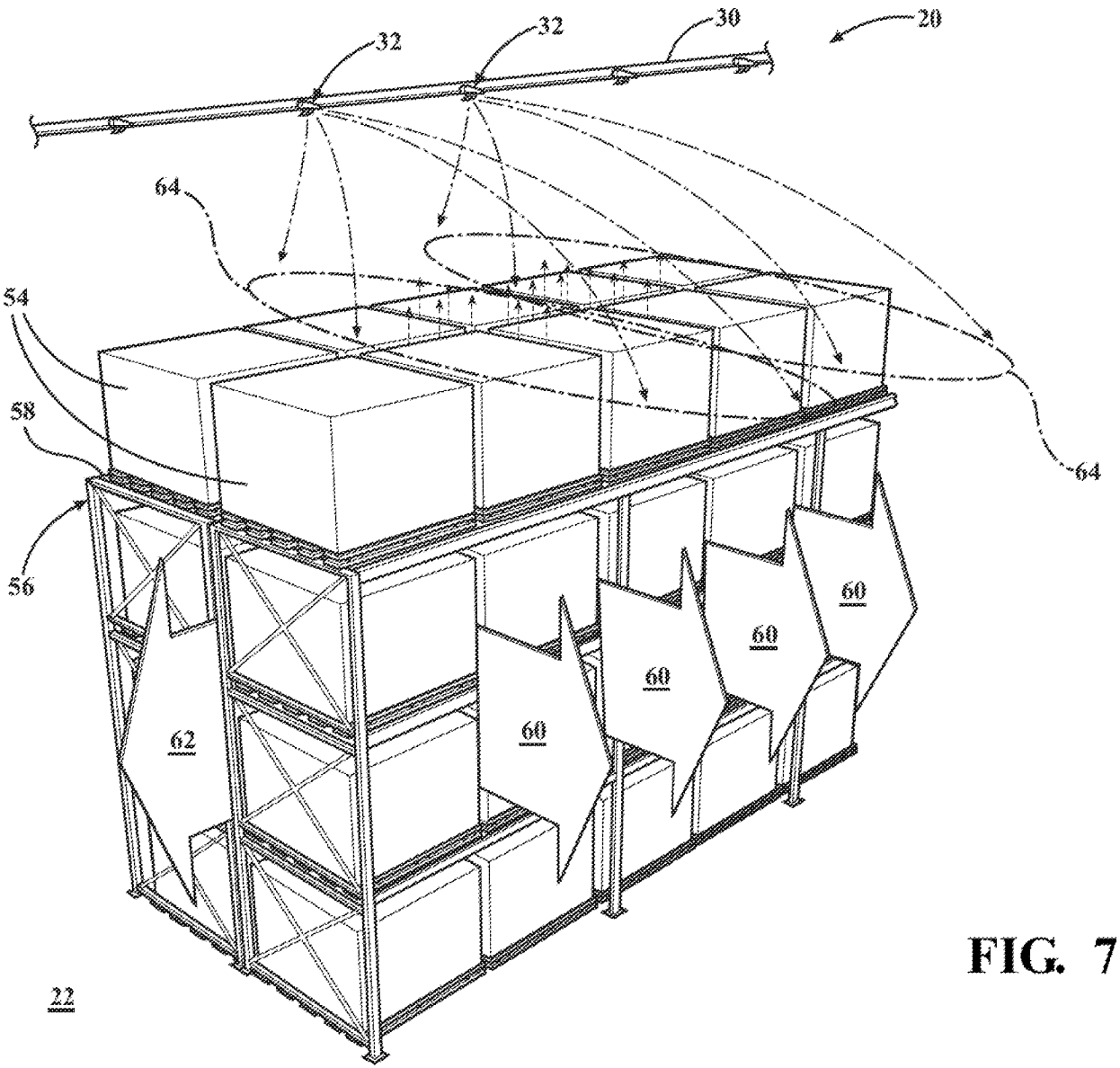
FIG. 7 is a perspective view showing the sprinkler system of one embodiment installed above storage items and with two fire sprinkler heads activated in response to heat rising from the flues in-between the storage items.

In FIG. 7, storage items 54 are shown disposed on the floor 22 in the warehouse. In a warehouse, storage items 54 are frequently stacked or arranged in long rows. Also commonly, the storage items 54 may be stacked in elongated storage racks, generally indicated at 56, which in turn are disposed on the floor 22 in the warehouse. In FIG. 7, one such storage rack 56 is shown. Commonly, a warehouse facility will arrange many storage racks 56 in opposite-facing pairs separated by aisles large enough for a forklift to maneuver. The common storage rack 56 has a plurality of shelves 58 upon which are placed the storage items 54. Oftentimes, the storage items 54 are palletized, or otherwise carried on standard 4×4 pallets to facilitate handling with a forklift (no shown). Of particular note is the overall height of the storage items 54 either standing free or when arranged in rows. When storage items 54 are stacked in shelves 58 of the storage racks 56, the lofty storage items 54 on the uppermost shelf 56 will define the overall height, which is the highest level or region of goods that must be protected by the fire suppression system 20.

Within this context, the fire suppression system 20 is suspended from above in the warehouse, at an elevation that is greater than the overall height of the storage items 54 disposed below. In the event of a fire, wherein it is presumed that the locus of the fire is in or at a storage item 54 somewhere in a storage rack 56. The arrangement of storage racks 56 and the typical placement of palletized storage items 54 on the various levels of shelves 58 in the storage racks 56 establish a plurality of transverse flues 60 and one longitudinal flue 62. These flues 60, 62 are indicated by wide directional arrows. Naturally, such flues 60, 62 can exist in solid-pile (non-racked) type storage arrangements. The transverse flues 60 are formed in the gaps between adjacent storage items 54. The longitudinal flue 62 is created in the gap between two storage racks 56 when arranged back-to-back. The importance of these flues 60, 62 becomes relevant when a fire is present in or adjacent one of the storage items 54. Perhaps a worst-case scenario in terms of fire suppression is when a fire originates between two storage racks 56 arranged back-to-back (i.e., in the longitudinal flue 62 area) at or near the floor 22, which is suggested by heat arrows rising from the flues 60, 62 in FIG. 7. This is the most distant and difficult to reach region for fire suppressing liquid dispersed from a fire sprinkler 32.

The fire produces hot combustion gases that travel upwardly through the narrow flues 60, 62 like chimneys. When the escaping heat is sufficient to activate at least one nearby overhead fire sprinkler 32, water (or other fire suppressing liquid) will be discharged. In order to be effective, the water must travel down the very same flues 60, 62 through which heat from the fire is rising up. The rising heat, concentrated within the narrow passageways of the flues 60, 62, will vaporize the descending water spray unless sufficient quantities of water and/or large enough droplet sizes can be applied to overpower the heat. The greatest success at fire suppression will be achieved when, at the initial stages of a fire, a maximum amount of water is applied to the flues 60, 62 directly above the fire locus.

The present fire suppression system 20 is configured and arranged so that, at all stages of a fire but particularly at the initial stages, a maximum amount of water is applied to the flues 60, 62 laying directly above the fire so that very little spray is wasted dousing nearby (non-burning) storage items 54. Furthermore, the fire suppression system 20 is capable of generating a water curtain effect that resists spread of the fire to adjacent storage racks 56. In the event of fire in a storage rack 56, the activated fire sprinklers 32 will create a beneficial water curtain in the adjacent aisles and/or flues 60, 62 to discourage fire spread, thereby helping to contain the fire in the smallest possible region. This invention is uniquely designed to combat fires in warehouse settings where storage items 54 are tightly stacked or arranged and water from activated fire sprinklers 32 must travel into narrow flues 60, 62 to reach a fire.

Figure 8:
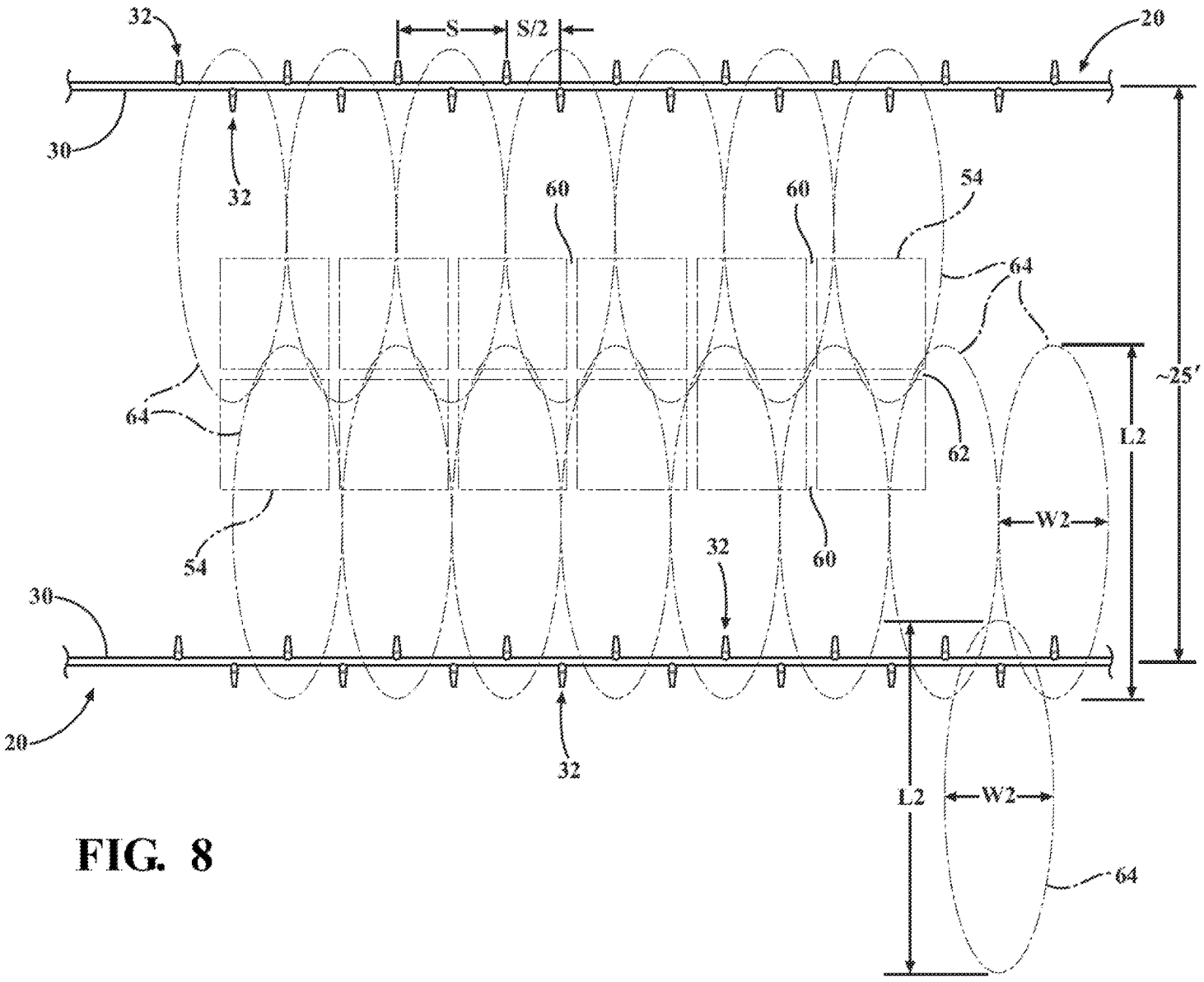
FIG. 8 is a top view showing two parallel supply lines arranged over a row of storage items, each supply line being fitted with opposite-facing sprinkler heads according to one embodiment of the present invention, and further illustrating exemplary spray discharge patterns from several of the sprinkler heads to illustrate an exemplary coverage strategy.

FIG. 8 is a simplified top view of a fire suppression system 20 according to one embodiment of this invention where two adjacent supply lines 30 (i.e., first and second) are disposed in a building structure, perhaps arranged along the centerlines of two adjacent bay areas between three adjacent beams 24 like that shown in FIG. 3. As an example, the spacing between the two adjacent supply lines 30 may be about twenty-five feet. Of course, an installer or a qualified spec writer may decide that the spacing between the two adjacent supply lines 30 should be larger or smaller. Each sprinkler head 32 is schematically illustrated and arranged in the aforementioned alternating fashion with blocking surfaces protecting its trigger 40. Furthermore, if one were to rotate FIG. 8 ninety degrees in a counter-clockwise direction, the left-hand supply line 30 could be considered the "first" and the right-hand supply line 30 the "second." It is then evident that the fire sprinklers 32 on the right side C of the first supply line 30 face toward the second supply line 30. And similarly, the fire sprinklers 32 on the left side B of the second supply line 30 face toward the first supply line 30. In other words, the fire sprinklers 32 on the left side B of the second supply line 30 point toward the fire sprinklers 32 on the right side C of the first supply line 30 somewhat like the cannons of two ancient battleships.

As stated previously, each fire sprinkler 32 is configured to disperse an outflow of fire-suppressing liquid over a non-circular individual coverage area 64. The coverage areas 64 are represented by broken lines in FIGS. 7-9, as may be understood as the point of contact with the uppermost surfaces of storage items 54 located on the highest elevation shelves 58 in the storage racks 56. Standard prior art side-discharge sprinkler heads, which are usually intended for wall-mounted applications, typically disperse water over a generally semi-circular area. While standard prior art side discharge sprinkler heads are suitable for use with the present invention, in the preferred embodiment the deflectors are configured so that the coverage areas 64 are more elongated in shape. The non-circular individual coverage areas 64 from any paired fire sprinklers 32 are contiguous and generally mirrored. If any paired fire sprinklers 32 are placed directly back-to-back along the supply line 30, then their combined coverage areas 64 would merge and define a generally elliptical or oval or rectangular area. However, in the illustrated examples paired fire sprinklers 32 are longitudinally offset along the supply line 30 so that their respective coverage areas 64 are likewise offset, as well as focused in opposite directions, as shown in the lower right-hand corner of FIG. 8.

Figure 9:
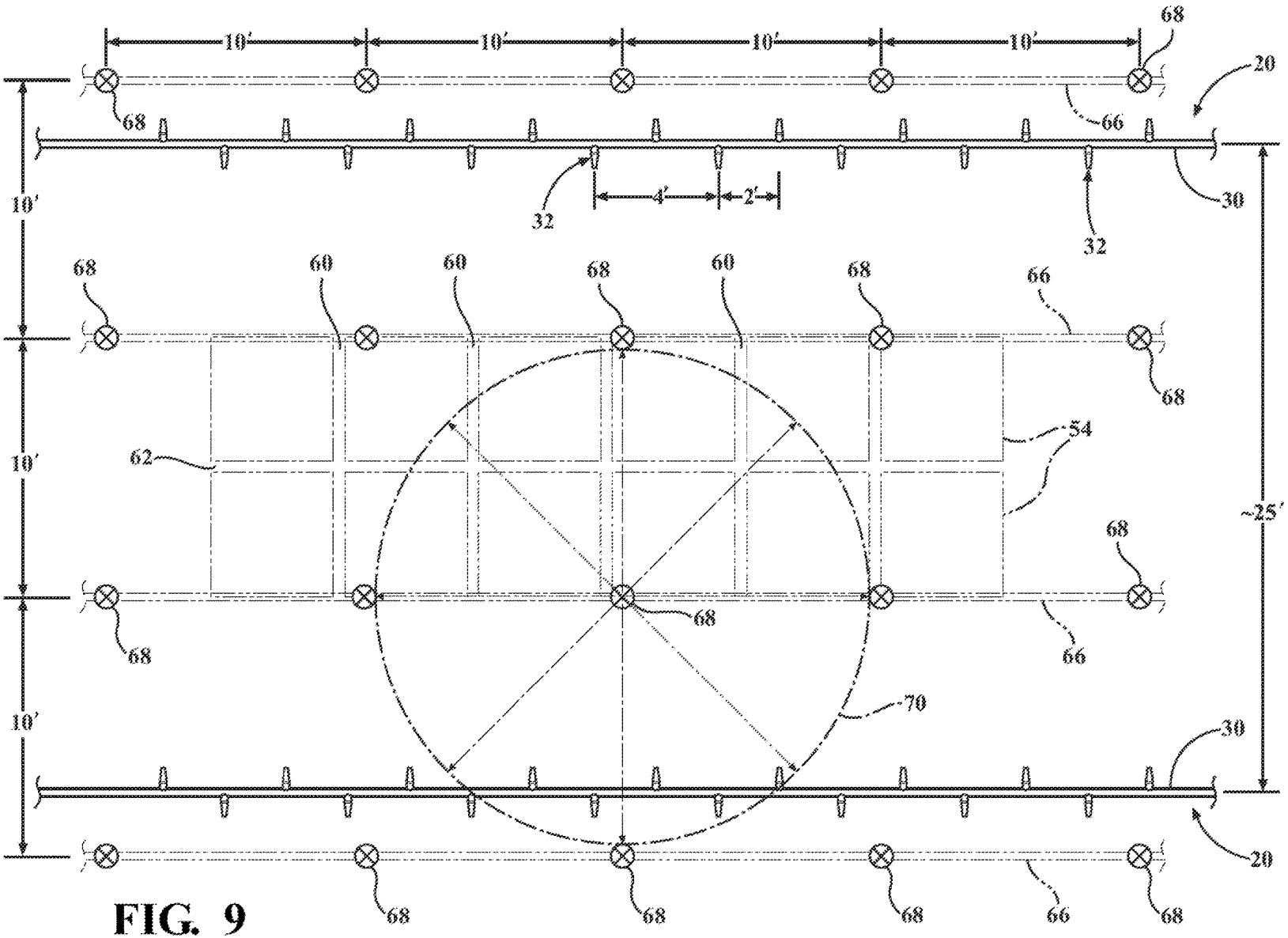
FIG. 9 is a view as in FIG. 8 but further superimposing a prior art fire suppression system comprising four supply lines with omni-directional heads arranged in the common 10'×10' grid pattern for comparison purposes.

The coverage area 64 from each sprinkler head 32 has a major diameter L2 which is generally perpendicular to the supply line 30 and a shorter minor diameter W2 that is generally parallel to the supply line 30. While the terms "major diameter" and "minor diameter" are suggestive of elliptical geometries, and indeed several of the Figures depict elliptical shapes, it should be understood that coverage areas could have oval or rectangular geometries, or other suitable shape as may be deemed acceptable. The minor diameter W2 is preferably between about 5% and 100% of the major diameter L2, and in some preferred embodiments W2 is between about 15% and 67% of L2. More preferably still, W2 may be less than 50% of L2 in order to produce a discharge jet that more closely mimics the powerful stream from a fire hose. The major diameter L2 is preferably smaller than the perpendicular spacing between the first and second supply lines 30, and also preferably slightly larger than half the distance between adjacent supply lines 30 to account for some degree of overlap. So in the example of FIG. 8, where the distance between adjacent supply lines 30 is shown as twenty-five feet, the L2 is preferably somewhat greater than twelve-and-a-half feet—perhaps about fourteen feet. Every other sprinkler head 32 located along the same supply line 30 is spaced apart by a spacing distance S. That is to say, when considering only the sprinkler heads 32 on one side (left B or right C) of the supply line 30, the separation intervals are the spacing distance S, as shown in FIGS. 3 and 8. The minor diameter W2 of the combined coverage area is slightly larger than the spacing distance S to account for some degree of overlap. In one embodiment of the invention, the spacing distance S is between about two feet and ten feet. In the example of FIG. 9, the spacing distance S is four feet. In the example where the spacing distance S is four feet, W2 is preferably somewhat greater than four feet—perhaps about five to six feet which is less than 50% of L2.

Preferably the sprinklers 32 of this invention are installed in an optional stagger spaced arrangement both along the respective supply lines 30 and also within the structure. The stagger spaced arrangement is designed to redirect the sprays of water into the structure with strategically interwoven coverage areas. According to this arrangement, for each adjacent pair of first and second supply lines 30 extending parallel to one another, opposing sprinkler heads 32 are set in an offset relationship relative to one another. That is, the inwardly facing sprinklers 32 along one supply line 30 are not pointing directly at, i.e., not in line with, the inwardly facing sprinklers 32 of the other supply line 30. Said another way, the coverage area 64 from a sprinkler 32 on one supply line 30 is longitudinally (i.e., along the length of a supply line 30) offset from the coverage area 64 of an opposing sprinkler 32 on the next adjacent supply line 30. Thus, a person standing on the floor 22 in the building and looking up toward the roof 27 will observe that as between two adjacent supply lines 30 the rightward-pointing sprinklers 32 on the first supply line 30 do not line up in the L1/L2 directions with the leftward-pointing sprinklers 32 on the second supply line 30; the heads 32 are in fact staggered in an alternating fashion. Preferably, the off-set is equal to approximately one-half of the spacing distance S, or "S/2" as shown in FIG. 8. In the example of FIG. 9, where the spacing distance S is four feet, the longitudinal offset is two feet.

FIG. 8 shows this stagger spacing arrangement, where the combined elliptical coverage areas 64 are similar in some respects to those described in my co-pending US Patent Publication No. 2015/0034341 published Feb. 5, 2015, the entire disclosure of which is hereby incorporated by reference. However in this present invention the inwardly pointing coverage areas 64 between each adjacent pair of supply lines 30 are offset to one another. Furthermore, according to the illustrated example of this invention, along one supply line 30 each paired set of sprinklers 32 are longitudinally offset from one another by the same half spacing S/2 in a regular alternating pattern. In this manner, a design spacing distance S is calculated or otherwise predetermined to disperse water over the underlying combined coverage areas 64. The sprinklers 32 on right side C of the first supply line 30 are arranged in-between the opposing sprinklers 32 on the second adjacent supply line 30 (i.e., on the left side B) side so that the inflows of coverage areas 64 applied between these two supply lines 30 are spaced equally with the half spacing distance (S/2). In this manner, the coverage areas 64 are interleaved with one another, and depending on the W2 and L2 dimensions may even overlap one another. In the example of FIG. 8, the major diameter L2 of each combined coverage area 64 is optimally distributed into the cove or valley-like regions between the coverage areas 64 in the two opposing sprinklers 32 of the adjacent supply line. Thus, the interlaced coverage areas 64 by two opposing sprinklers 32 achieve and optimal use of water. However, given that water pressure has a direct effect on the actual size of the coverage area 64, and because water pressure will diminish as more fire sprinklers 32 are activated, it may be desirable to design a fairly generous overlap—on the order of one to three feet—for a single-activated fire sprinkler 32. It is therefore understood that as water pressure diminishes due to additional fire sprinklers 32 being activated, the modestly shrinking coverage area 64 will remain in an ideal geometric condition with the next adjacent coverage area 64. Therefore, the degree of overlap needed between adjacent coverage areas 64 is preferably calculated for each installation based on line pressure, supply line 30 sizes and other relevant factors.

In the example of FIG. 8, the minor diameter W2 of each coverage area 64 is at least equal to S, and more preferably is between about S and 2S (i.e., between one and two times S). In this example, the major diameter L2 of each coverage area 64 is greater than half the distance between adjacent supply lines 30 (e.g., >12.5 feet) so that at its farthest end the coverage area 64 reaches into the cove or valley-like space between the coverage areas 64 in the two opposing sprinkler sets 32 of the adjacent supply line 30. The large lateral reach in the major diameter L2 direction can be particularly benefitted when installed in a structure fitted with open web type beams 24, such that the supply lines 30 can be located very near to the ceiling with water sprays easily passing through the open webbings. It is to be understood that the illustrated examples fully contemplate extension of these teachings to buildings that have many bays, with the stagger spacing concepts being repeated between every two adjacent supply lines 30.

A particular advantage of the present invention can be readily appreciated by comparing FIG. 9, which overlays a typical prior art sprinkler system with the novel stagger spacing concepts depicted in FIG. 8. The prior art system is identified by supply lines 66 (drawn as broken lines) carrying traditional pendant style spray heads 68. The superimposed prior art system shown here may be of the Early Suppression Fast Response (ESFR) type in which fast response sprinklers 68 are designed to discharge a high effective water density in order to combat a fire plume, particularly in high rack storage applications. In a typical prior art ESFR system, the supply lines 66 are spaced apart ten feet and the sprinkler heads 68 are spaced apart ten feet. This places the prior art sprinkler heads 68 in a ten-by-ten foot grid pattern.

As shown in FIG. 9, a prior art ESFR system requires about four supply lines 66 to cover the same area as the present suppression system 20 having only two supply lines 30. The labor savings represented by a 50% reduction is supply line installation is significant. Furthermore, as will be validated below, the supply lines 30 of the present invention can be smaller in diameter than the prior art ESFR supply lines 66, thus representing a further cost reduction, as well as a weight reduction which translates to smaller supporting brackets and possibly smaller purlins or other structural elements from which the supply lines 30 are hung.

The prior art spray heads 68 are shown having the typical circular spray pattern 70 (only one spray pattern 70 shown for simplicity). If the prior art ESFR is presumed to be supplied with water at 52 psi, which is a common specification, and the ESFR spray heads 68 are rated at a 16.8 k-factor, a reasonable assumption, then the discharge rates from each spray head 68 can be calculated at about 121 gallons per minute using the formula:

$$q=k*p^{0.5}$$

Where:

q is the flow rate;

k is the nozzle discharge coefficient; and p is the line pressure

Assuming the prior art spray heads 68 are spaced ten feet apart, each spray head 68 is responsible for about one hundred square feet of area and the applied water density onto the storage items 54 per spray head 68 will be in the order of about 1.21 gallons/square foot. In contrast, the system 20 of the present invention may be fitted, for example, with supply lines 30 that carry 35 psi water pressure and spray heads 32 having a k-factor of 14. At these specifications, water distribution from each spray head 32 will be on the order of about 83 gpm. However, if the coverage areas 64 for the sprinkler heads 32 are defined by W2 at four feet and L2 at fourteen feet, the applied water density per spray head 32 onto the storage items 54 will be in the order of about 1.48 gallons/square foot. In other words, the present invention contemplates applying more gallons per square foot through each spray head 32 than is achieved by a typical prior art ESFR type spray head 68 of a larger k-factor and using higher line pressures.

Of course, the critical objective is to arrest growth of a fire at the earliest possible moment. When the initial sprinkler head 68 of the prior art activates, only the 1.21 gallons/square foot is applied. And with spray heads 68 set the typical ten feet apart, it may take several precious moments for additional spray heads 68 to activate. In contrast, the spray heads 32 of the present invention are set at a much closer spacing S, which spacing is further reduced to S/2 (or other fraction) by the novel stagger arrangement, so that more sprinkler heads 32 will be activated more quickly with respective coverage areas being more accurately distributed toward the fire plume. As a result, more water is directed at the fire more quickly than prior art systems.

That is to say, heat from a fire plume will initially activate more adjacent sprinkler heads 32 due to the close and stagger spacing features of this invention. Because of the directional, non-circular projection 64 of water spray from activated spray heads 32, it is expected that a majority of discharged water will be directed toward the fire. As a result, water usage is reduced (compared to the prior art) and the potential for collateral water damage is similarly reduced. Importantly also, a maximum discharge of water is directed at the nascent fire, thereby increasing the likelihood that the fire will be rapidly suppressed. That is to say, in comparison with the prior art, less pressure robbing water is wasted spraying away from the fire and causing collateral water damage to otherwise unaffected storage items 54. More water is thus available to apply directly into the flues 60, 62 with an increased opportunity to control the fire before it has a chance to spread.

Benefits of this present invention are many. The blocking surfaces enable the use of side-discharge type sprinklers (special application types listed for the given fire scenario) that can be supplied from any reputable manufacturer, or more preferably the unique sprinkler heads 32 described above. Increased water density can be provided compared with standard, vertically oriented sprinklers 68. Less water damage might occur in cases where only one sprinkler 32 is activated. And the cost of installation is predicted to be less than that of prior art ESFR systems.

The claim of increased water density is accomplished by the ability of this present invention to utilize side-discharge type sprinklers 32 that have the ability to more accurately distribute water toward underlying storage items 54. The claim of reduced installation cost results from the use of one common supply line 30 per bay area (as compared with two supply lines according to prior art techniques like that taught by U.S. Pat. No. 7,331,399) and also from the potential to separate supply lines 30 a relatively large distance apart (e.g., twenty-five feet) due to the long, narrow and staggered coverage areas of this present invention. In particular, the non-circular coverage area 64 of each spray head 32 has a major diameter L2 and a smaller minor diameter W2 that penetrates into the flues 60, 62. The narrow width measure W2 allows spray heads 32 to be stationed closer together along a common supply line 30, which in turn increases chances that multiple spray heads 32 will be activated and thereby apply more water into the flues 60, 62 where a fire plume is growing. Furthermore, water droplet size and water velocity will be increased due to the added water pressure and volume, which large droplet size helps to force more water into the flues 60, 62 against a counter-flow of heat from the fire.

The staggered, interlaced non-circular coverage areas 64 of the fire suppression system 20 will discharge water onto the storage items 54 with a high degree of hydraulic efficiency. Through large scale fire tests, where fire suppressing systems and fire sprinkler components are evaluated in a scientific setting, fire control has been proven to be most effective by maximizing the following system variables: water discharge velocity, k factor and water droplet size. Fire control is typically improved by: greater water velocity, higher k factor and/or larger water droplet size. The elongated nature of each coverage area 64, where the major diameter (L2) is significantly greater than the minor diameter (W2), produces a pattern that more closely mimics a fire hose stream projected at the fire plume. This, in turn, produces larger water droplet size and increases water discharge velocity, while operating at less pressure and volume. Larger water droplets are beneficial because they are less sensitive to the heat rising through the flues 60, 62. That is, larger droplets better penetrate through the flues 60, 62 to reach the fire. Likewise, higher velocity water spray coupled with greater water density also penetrates the narrow flues 60, 62 as compared with a slower moving, lower density water spray as in prior art systems.

The relatively narrow widths W2 (minor diameters) of the coverage areas 64 advantageously enables relatively close spacing (S) of the fire sprinklers 32 along the supply line 30. This close spacing (S) of heads 32 along the same side of the same supply line 30 provides numerous key benefits, perhaps chief among which is an improved ability to penetrate the fire flues 60, 62. The unique opposite-facing design utilizing side-discharge style fire sprinklers 32 enables a more precise aim directly into the fire flues 60, 62 thus resulting in a more efficient fire suppression system with the sprayed water in large quantities going where it is most needed. Furthermore, the close spacing interval (S) between sprinkler heads 32 along the same side of the same supply line 30 encourages a condition where more sprinkler heads 32 in the vicinity of a fire are activated rather than fewer. Multiple activated spray heads 32 will have a greater chance of avoiding obstructions and a greater chance of penetrating the fire flues 60, 62 because of the tighter spacing. That is to say, because two or three spray heads 32 are more likely to be initially activated when in the past only one spray head is initially activated, any physical obstructions—like low beams 24, structural columns, equipment or atypically large objects—will not be as likely to block the initial water spray in cases whether the obstruction is between one spray head 32 and the fire. Not to mention, greater distance between adjacent supply lines 30 improves the probability that each supply line 30 can be placed in its own bay between adjacent beams 24 as shown in FIGS. 3 and 4 where they will not be as susceptible to blockage by low-hanging beams 24.

Furthermore, multiple activated spray heads 32 that discharge long, narrow streams of water like a firehose will better attack a fire in the deep interior regions of stacked storage items 54 via the only direct avenues—the flues 60, 62. Even using spray heads 32 with a smaller k-factor fed by lower line pressure, it was shown (above) that larger water distributions (gallons/sq. foot) are possible because the coverage areas 64 are smaller by comparison to prior art ESFR systems. The long, narrow coverage areas 64 are not only accurately aimed toward a fire, but also naturally produce larger water droplets via the design of the deflector which effectively produces an outflow like a hose stream. As a result, water is delivered in a greater density where it is needed the most—into the flues 60, 62. This hose stream effect also works as a fire stop because the water and the droplet sizes are denser. This invention, which may be characterized as a "spot density theory," goes against the way conventional heads 68 are built, which is on the basis of density (volume/area). Those of skill in the art will acknowledge that there are many shortcomings of the prior art paradigms which place a high premium on density—that is, on blanketing the entire footprint of the storage area with a balanced density of water. In contrast, the spot density theory advanced here allows an early onset fire to be quickly blocked from growing by the hose stream coverage area(s) 64 produced by one or more activated spray heads 32 of this invention. Accordingly, early stage fire suppression success rates will increase based on the principles of this invention.

Figure 10:
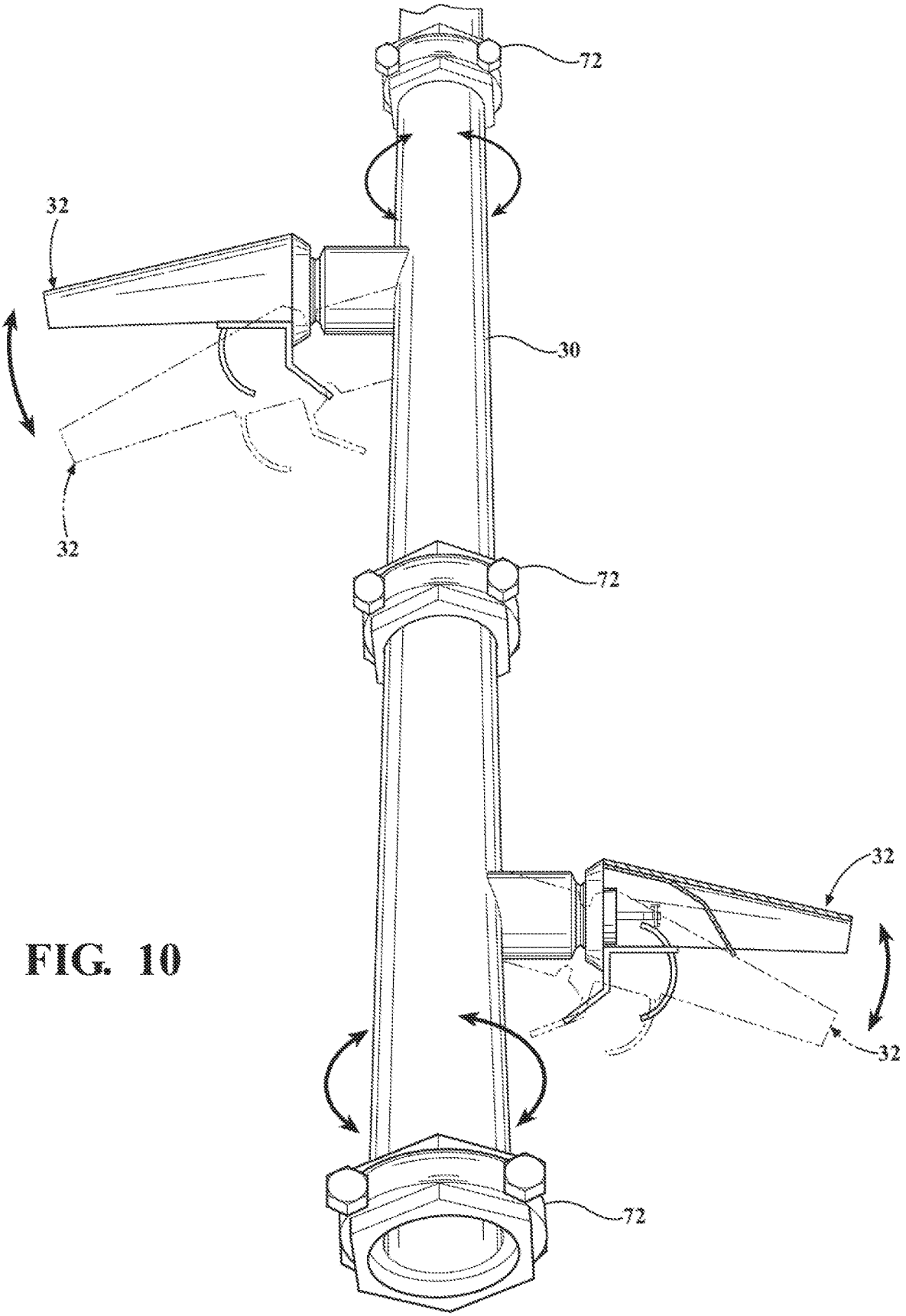
FIG. 10 is a perspective view as in FIG. 4 but showing an optional adjustment scheme whereby the coverage patterns can be individually adjusted to suit the storage conditions.

FIG. 10 describes an alternative embodiment wherein the supply line 30 is composed of multiple short sections joined end-to-end by couplings 72. The couplings 72 may be any commercially available type, such as the grooved pipe joining technology marketed by the Victaulic Company of Easton, PA to name but one possible source. Alluding back to FIG. 4, where by phantom lines it was described that a sprinkler 32 may be skewed relative to horizontal as an alternative to adjusting its deflector in order to achieve a desire placement of the coverage area 64, FIG. 10 represents a method by which adjustment can be accomplished after placement of the sprinkler 32 and without altering its deflectors. In the Applicant's co-pending US Publication No. 2015/0034341, attention is given to the concept of configuring and arranging the coverage areas 64 relative to the overall height and location of the storage items 54 so that, at all stages of a fire but particularly at the initial stages, a maximum amount of water is applied to the flues 60, 62 laying directly above the fire so that very little spray is wasted dousing nearby (non-burning) storage items. For all of the reasons therein described, it is desirable to install the present fire suppression system 20 so that the coverage areas 62 are matched to the height and location of the nearby storage items 54. However, over time the owner of a warehouse is likely to change the height and/or location of the storage items 54, such that the alignment of coverage areas 64 becomes outdated. By loosening the couplings 72 at each end of a section of supply line 30, the supply line 30 can be rotated and with it the sprinkler head 32 carried thereon. By careful attention, the coverage area 64 of each spray head 32 can be adjusted whenever there is a change in the height and/or location of the storage items 54 in order to achieve the benefits and objectives explained in US Publication No. 2015/0034341.

The foregoing invention has been described in accordance with the relevant legal standards, thus the description is exemplary rather than limiting in nature. Variations and modifications to the disclosed embodiment may become apparent to those skilled in the art and fall within the scope of the invention. Furthermore, particular features of one embodiment can replace corresponding features in another embodiment or can supplement other embodiments unless otherwise indicated by the drawings or this specification.

What is claimed is:

1. An over-head fire suppression system configured to disperse a stream of liquid water in a downward trajectory onto a coverage area, said system comprising:

an elongated tubular supply line configured as a conduit to carry liquid water, said supply line having a longitudinal centerline, said supply line having right and left sides separated by a vertical plane passing through said longitudinal centerline, a plurality of side-discharge fire sprinklers coupled directly to said supply line, each said fire sprinkler receiving liquid water from said supply line, each said fire sprinkler including a deflector configured to disperse the liquid water in a jet stream having a downward trajectory over a non-circular coverage area defined by a major diameter and a shorter minor diameter, each said side-discharge fire sprinkler including a dedicated temperature-sensitive trigger that when activated permits the water to flow in a liquid spray from said side-discharge fire sprinkler only toward said side coverage area, said plurality of fire sprinklers arranged so that half of said fire sprinklers are disposed on said right side of said supply line and the other half of said fire sprinklers are disposed on left side of said supply line in alternating fashion such that every other said fire sprinkler is disposed on said right side of said supply line with the other said fire sprinklers disposed in interleaved fashion on said left side of said supply line, said fire sprinklers disposed on said right side of said supply line being spaced apart one from the next by a spacing distance (S), and said fire sprinklers disposed on said left side of said supply line being spaced apart one from the next by the same said spacing distance (S).

2. The system of claim 1 further including at least one blocking surface supported on said supply line in-between adjacent said fire sprinklers, said blocking surface configured to impede liquid water discharged from one said fire sprinkler from contacting a nearby said fire sprinkler and thereby avoid cold soldering, said at least one blocking surface comprises one or more integral portions of said deflector.

3. The system of claim 1 wherein each said fire sprinkler includes nipple connected to said supply line to receive the outflow of liquid water, a closure plugging said nipple to prevent the flow of liquid water therethrough, said trigger operatively associated with said closure, at least one blocking surface supported on said supply line in-between adjacent said fire sprinklers, said at least one blocking surface substantially enclosing at least three sides of said trigger.

4. The system of claim 3 where each said fire sprinkler includes a frame connected to said nipple, said deflector including a hood attached to said frame, said hood having a generally semi-cylindrical configuration.

5. The system of claim 4 wherein said deflector further includes at least one baffle disposed inside said hood.

6. The system of claim 4 wherein said deflector further includes at least one downwash section disposed below said hood.

7. The system of claim 1 wherein said supply line includes at least one segment with at least one fire sprinkler disposed along said segment, a coupling disposed on opposite ends of said segment, said couplings configured to permit said segment to be rotated in order to adjust the angular position of said at least one fire sprinkler disposed along said segment.

8. The system of claim 1 wherein each fire sprinkler is separated from the next adjacent said fire sprinkler by a generally equal spacing interval (S/2) equal to half of said spacing distance (S).

9. The system of claim 1 wherein said major diameter of said noncircular coverage area is generally perpendicular to said supply line and said minor diameter is generally parallel to said supply line.

10. An over-head fire suppression system configured to disperse a stream of liquid water in a downward trajectory onto a coverage area, said system comprising:

a first elongated tubular supply line configured as a conduit to carry liquid water, said first supply line having a longitudinal centerline and right and left sides separated by a vertical plane passing through said longitudinal centerline, a plurality of side-discharge first fire sprinklers coupled directly to said right side of said first supply line, each said first fire sprinkler receiving a flow of fire-suppressing liquid water from said first supply line, each said first fire sprinkler including a deflector configured to disperse the flow of liquid water in a jet stream having a downward trajectory over a non-circular coverage area, each said first fire sprinkler being separated from the next adjacent said first fire sprinkler by a generally equal spacing distance (S), each said first fire sprinkler including a dedicated temperature-sensitive trigger that when activated permits the water to flow in a liquid spray from said first fire sprinkler only, a second elongated tubular supply line configured as a conduit to carry liquid water, said second supply line having a longitudinal centerline and right and left sides separated by a vertical plane passing through said longitudinal centerline, said second supply line disposed parallel to said first supply line with said left side of said second supply line facing toward said right side of said first supply line, a plurality of side-discharge second fire sprinklers coupled directly to said left side of said second supply line, each said second fire sprinkler receiving liquid water from said second supply line, each said second fire sprinkler including a deflector configured to disperse the liquid water in a downward trajectory over a non-circular coverage area, each said second fire sprinkler being separated from the next adjacent said second fire sprinkler by a generally equal spacing distance (S), each said second fire sprinkler including a dedicated temperature-sensitive trigger that when activated permits the water to flow in a liquid spray from said second fire sprinkler only, and said spacing distance (S) between said first fire sprinklers being generally equal to said spacing interval distance (S) between said second fire sprinklers, wherein each said first fire sprinkler is separated from the next adjacent said second fire sprinklers by a spacing interval (S/2) equal to half of said spacing distance (S), said non-circular coverage areas from said first fire sprinklers being interlaced between said non-circular coverage areas from said second fire sprinklers.

11. The system of claim 10 wherein each said coverage area is defined by a major diameter (L2) generally perpendicular to the respective said supply line and a shorter minor diameter (W2) generally parallel to the respective said supply line, and wherein said minor diameter (W2) is less than two times said spacing interval but greater than said spacing interval, and wherein said major diameter (L2) is less than the perpendicular distance between said first and said second supply lines but greater than the one-half the perpendicular distance between said first and said second supply lines.

12. The system of claim 10, further including a warehouse, said warehouse including at least three beams suspended over a floor, said at least three beams arranged parallel to one another and generally equally spaced apart from one another by an interior length (L1), said at least three beams comprising a first beam and a second beam and a third beam, wherein said first supply line is disposed generally mid-way between said first and second beams and said second supply line is disposed generally mid-way between said second and third beams.

* * * * *